United States Patent [19]

Price

[11] 4,252,316

[45] Feb. 24, 1981

[54] WEIGHT LIFTING BAR

[76] Inventor: Paul J. Price, 1420 Junior Dr., Pittsburgh, Pa. 15227

[21] Appl. No.: 25,832

[22] Filed: Apr. 2, 1979

[51] Int. Cl.[3] ..... A63B 13/00

[52] U.S. Cl. ..... 272/123; 272/143; 272/DIG. 4

[58] Field of Search ..... 272/123, 122, DIG. 4, 272/117, 134, 143

[56] References Cited

U.S. PATENT DOCUMENTS

| | | | |
|---|---|---|---|
| 793,101 | 6/1905 | Schmidt | 272/122 |
| 3,726,522 | 4/1973 | Silberman | 272/123 |
| 3,825,253 | 7/1974 | Speyer | 272/123 |

*Primary Examiner*—William R. Browne
*Attorney, Agent, or Firm*—William J. Ruano

[57] ABSTRACT

A weight lifting bar having accessory plate hangers depending from each end of the bar to support weights at right angles or parallel to the bar at a selected distance below the bar so as to enable the bar to be used for exercising under certain conditions, such as when lifting the weights in the vicinity of a ceiling, or getting underneath the bar to be on the floor before lifting. The accessories are detachably removed to enable the weights to be slid and attached directly on the ends of the bar, as in conventionally used bars.

5 Claims, 6 Drawing Figures

WEIGHT LIFTING BAR

This invention relates to a weight lifting or exercising bar.

An outstanding disadvantage of conventionally used weight lifting bars is that they create problems under certain circumstances of exercising. For example, when the lifter raises the bar to ceiling height in his home, there is apt to be a collision of the weights, which project upwardly of the bar, with the ceiling.

Another disadvantage of a conventional bar is that it does not enable the weight lifter to get underneath it, while lying on the floor, to raise the weights from the floor.

An object of the present invention is to overcome the above named disadvantages and to provide a weight lifting bar which can be used either while raising the bar to ceiling height and which will enable the weight lifter to lie on the floor underneath the bar before raising the bar.

Another object of the present invention is to provide a novel convertible accessory at each end of the bar which will enable the abovementioned ceiling raising exercises and yet which enables the bar to be easily and quickly converted to a conventional weight lifting bar by mere detachment of the depending accessories.

Another object of the invention is to provide a weight lifting bar that eliminates the need or use of a bench which is now conventionally used to get the weights in high position over the chest while the lifter is lying on the bench.

Other objects and advantages of the invention will become more apparent from a study of the following description taken with the accompanying drawings wherein.

Figure 1:
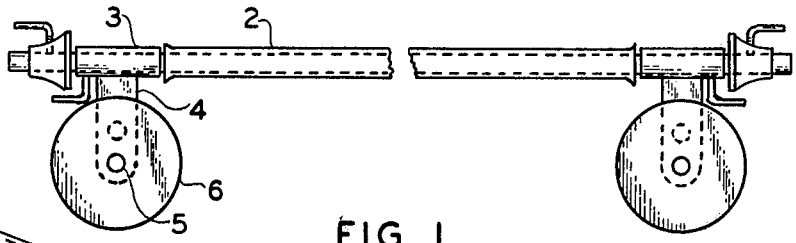
FIG. 1 is an elevational view of a weight lifting bar embodying the present invention.
Figure 2:
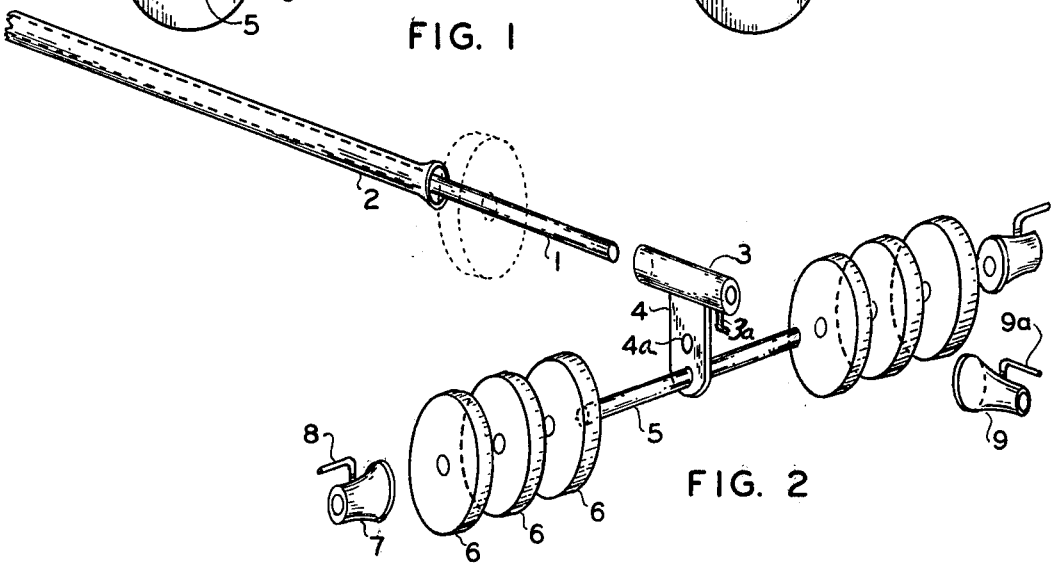
FIG. 2 is an exploded perspective showing the novel convertible accessory at each end of the bar.

Referring more particularly to FIGS. 1 and 2 of the drawing, numeral 1 denotes a solid cylindrical bar of conventional construction, usually of steel, which includes a surrounding, freely rotatable sleeve 2 which is shorter in length than bar 1 in order to accomodate weights which would normally be slid onto the end portions of bar 1 and held tightly in place, as in a conventional weight lifting bar.

In accordance with the present invention, a pair of accessories are provided at the ends of the bar, each comprising a pipe sleeve 3 and an integral depending bar or plate hanger 4 which is either welded or integrally molded together with sleeve 3, such as by forging or casting. If desired, plate 4 may have an additional hole or holes 4*a* for selectively inserting round bar 5 therethrough if less height is required between the weights 6 and the bar 1. The round bar 5 may be rigidly secured, such as by welding, to the bottom portion of bar or plate hanger 4. Set screw 3*a* is optional.

One or more weights 6 which may be of different weights, such as 5 or 10 pounds, are slid onto the round bar 5 on each side of the depending plate hanger 4 and when the desired number of weights are in place, they may be held rigidly by end collars 7 having set screws 8 which clamp tightly against the round bar 5. Similarly, end collars 9 butting against sleeves 3 hold the sleeves against sleeve 2 by tightening of set screws 9*a*.

As stated previously, in order to convert back to a conventional lifting bar, it is necessary merely to loosen set screw 9*a* to withdraw the sleeve 3 and to take weights 6 and slide them directly onto the end portions of the bar 1 and to finally clamp the weights in place by tightening set screws 9*a* of end collars 9.

However, when the end assembly including the accessories 3,4 are used so as to position the weights lower than the bar 1, substantial advantages are obtained. For example, when the weight lifter raises the weight up to almost ceiling height, as in a home where low ceilings are existant, there is no danger when pressing the bar overhead of having the weights collide with the ceiling because they would be lower than the height of the conventional bar 1.

Another outstanding advantage is that the weight lifter can lie on the floor and still be able to do so underneath the lifting bar without the necessity of a conventional bench for holding the weight lifting bar at a predetermined height to clear his body.

While any desired clearance may be obtained between the floor and the bar, it has been found that a suitable height between the bar 5 and the sleeve 3 is about 8 inches and that a suitable height between the extra hole 4*a* and the sleeve 3 is about 5 inches.

Figure 3:
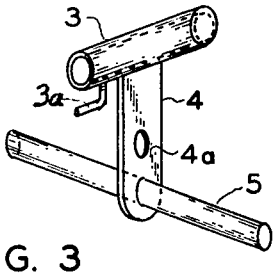
FIG. 3 is a elevational view of the end attachment or accessory embodying the principles of the invention.

FIG. 3 shows the accessory 3,4 for converting the bar from a conventional to a depending weight construction.

Figure 4:
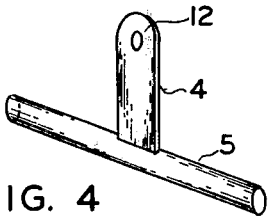
FIG. 4 is a perspective view of a modification thereof.

FIG. 4 shows a modification thereof which eliminates the sleeve 3 and instead provides merely a hole 12 which enables the plate hanger 4 to be slid onto the end portions of bar 1. The plate hanger 4 may be welded to the round bar 5. If desired, an additional hole, such as 4*a* in FIG. 3, may be provided (not shown).

Figure 6:
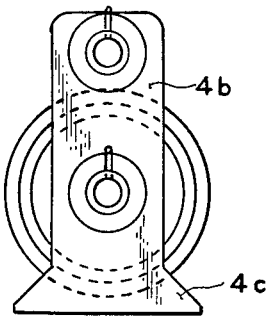
FIG. 6 is a side elevational view taken along the left side as viewed in FIG. 5
Figure 5:
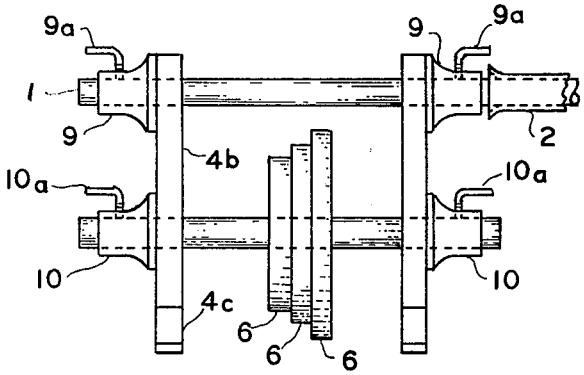
FIG. 5 is an elevational view of a modification of the weights supporting accessory.

FIGS. 5 and 6 show a further modification of the weight supporting assembly. Depending plate hangers 4*b* may be provided on each end portion of bar 1 and are preferably provided with outwardly flared pedestals 4*c* to provide a stable support on the floor. End collars, such as 9, 9*a*, 10, 10*a* are provided to hold the weights 6 in place and the collars are rigidly held in place by tightening the set screws 9*a*, 10*a*. By such stable support, there is little likelihood of tipping over of the bar when rested on the floor.

Thus it will be seen that I have provided a highly efficient and versatile weight lifting bar accessory which enables the weights to clear the ceiling when a weight lifter, in a standing position, presses the bar overhead, arms fully extended, also which allows the weight lifter to have sufficient body clearance so as to enable him to lie under the bar and then to proceed to press which eliminates the use of the bench now used to get the weight lifter to perform all of his other lifts and importantly the accessories are so constructed as to enable, when removed from the ends of the bar, reconversion of the weight lifting bar to a conventional one when the weights are coaxial with the lifting bar.

While I have illustrated and described several embodiments of my invention, it will be understood that these are by way of illustration only and that various changes and modifications may be contemplated in my invention within the scope of the following claims.

I claim:

1. A weight lifting bar, comprising an elongated cylindrical lifting bar surrounded by a freely rotatable sleeve which is of shorter length than said bar, an accessory at each end of said bar, each accessory comprising a sleeve which slides onto the end portions of said bar, a depending plate hanger, a weight supporting bar extending at right angles to said lifting bar through the lower portion of said plate hanger, selected weights mounted on said weight supporting bar on each side of said plate hanger, said weights having central holes for sliding engagement with said weight supporting bar, and means for clamping and holding tight said weights on said weight supporting bar whereby upon removal of said depending accessories, the weights may be slid directly onto the end of said lifting bar and clamped in place to convert the bar to a conventional weight lifting bar.

2. A weight lifting bar as recited in claim 1 wherein each of said accessories includes a sleeve which slides over the end portion of said weight lifting bar.

3. A weight lifting bar as recited in claim 1 wherein said plate hanger includes an additional hole to enable said weight supporting bar to be selectively slid into said hole to lower the clearance bwtween said weights and said weight lifting bar, said weight support bar being slidably engaged in the lower portion of said plate hanger.

4. A weight lifting bar as recited in claim 1 wherein said weight supporting bar at the bottom portion of said plate hanger is welded thereto.

5. A weight lifting bar, comprising an elongated cylindrical lifting bar surrounded by a freely rotatably sleeve which is of shorter length than said bar, an accessory at each end of said bar, each accessory comprising a sleeve which slides onto the end portion of said bar, a depending plate hanger, integral with said sleeve, a weight supporting bar extending through the lower portion of said plate hanger, selected weights mounted on said weight supporting bar, said weights having central holes for sliding engagement with said weight supporting bar, and means for clamping and holding tight said weights on said weight supporting bar whereby upon removal of said depending accessories, the weights may be slid directly onto the end of said lifting bar and clamped in place to convert the bar to a conventional weight lifting bar.

* * * * *